US008567473B2

(12) United States Patent
John et al.

(10) Patent No.: US 8,567,473 B2
(45) Date of Patent: Oct. 29, 2013

(54) WIRE MESH

(75) Inventors: Detlef John, Ahlen (DE); Helmut Schumacher, Oelde (DE)

(73) Assignee: Haver & Boecker OHG, Oelde (DE)

( * ) Notice: Subject to any disclaimer, the term of this patent is extended or adjusted under 35 U.S.C. 154(b) by 83 days.

(21) Appl. No.: 13/226,773

(22) Filed: Sep. 7, 2011

(65) Prior Publication Data

US 2012/0055533 A1 Mar. 8, 2012

(30) Foreign Application Priority Data

Sep. 7, 2010 (DE) ..... 10 2010 044 587

(51) Int. Cl.
*E06B 9/26* (2006.01)

(52) U.S. Cl.
USPC ..... 160/166.1; 160/127; 160/330; 245/11

(58) Field of Classification Search
USPC ..... 160/166.1, 330; 52/473; 245/1, 11
See application file for complete search history.

(56) References Cited

U.S. PATENT DOCUMENTS

| | | | | |
|---|---|---|---|---|
| 226,948 | A * | 4/1880 | Thomas | 417/405 |
| 1,218,556 | A * | 3/1917 | Hough | 160/219 |
| 3,015,156 | A * | 1/1962 | Ewing | 29/429 |
| 4,448,005 | A * | 5/1984 | Vochelli | 52/473 |
| 7,513,644 | B2 * | 4/2009 | Kufferath-Kassner et al. | 362/249.15 |
| 2005/0098277 | A1 * | 5/2005 | Bredemus et al. | 160/371 |
| 2007/0221342 | A1 * | 9/2007 | Chen | 160/236 |
| 2011/0126992 | A1 * | 6/2011 | Yordanova | 160/127 |
| 2012/0055533 | A1 * | 3/2012 | John et al. | 136/244 |

FOREIGN PATENT DOCUMENTS

| | | | |
|---|---|---|---|
| DE | 195805 | | 6/1907 |
| DE | 2029870 | A1 | 12/1971 |
| DE | 7823943 | U1 | 11/1978 |
| DE | 20104051 | U1 | 7/2002 |
| DE | 202005005957 | U1 | 6/2005 |
| FR | 2400178 | | 3/1979 |

* cited by examiner

*Primary Examiner* — Blair M. Johnson
(74) *Attorney, Agent, or Firm* — Pearne & Gordon LLP

(57) ABSTRACT

Wire mesh with warp and weft wires on a mesh surface with tube means spaced apart from each other being woven in on the mesh surface on which slat elements are located in order to serve for shading of the incidence of light. The slat elements can be provided with photovoltaic cells.

12 Claims, 3 Drawing Sheets

WIRE MESH

The present invention relates to a wire mesh with warp and weft wires on a mesh surface. From prior art such wire mesh has become known and is, for example, developed in an optically appealing way for sheathing of buildings as architectural mesh or, for example, for separating different areas of space. Likewise it is possible to use wire mesh as a filter material since due to the mesh size defined the given filter conditions can be observed in a reliable way.

Textile mesh made from natural fiber or synthetic fiber is produced in bulk today and can be manufactured in a flexible way. Compared with the manufacture of textile mesh, the expenditure when manufacturing wire mesh from metal wires is considerably higher. When weaving metal wires, the frictional forces occurring are considerably higher and the design of such weaving machines requires a far greater expenditure due to the loads occurring and the resulting wear and tear. Therefore, a possibly full utilization ratio of the weaving machine is aimed at. For this purpose, it is reasonable to expand the field of application of wire mesh and make available wire mesh for new applications and new structures.

It is therefore the object of the invention to provide a wire mesh which permits the use of wire mesh in fields of application where until now no wire mesh is used.

This object is achieved by a wire mesh with the features of claim 1 as well as by a wire mesh with the features of claim 13 and claim 14. Preferred further embodiments of the invention are the subject matter of the dependent claims.

Further advantages and features result from the general description of the invention and the embodiments.

A wire mesh according to the invention comprises warp wires and weft wires on a mesh surface with tube means spaced apart from each other being woven into the mesh surface on which slat elements are arranged to serve in particular for shading of incidence of light.

The wire mesh according to the invention has many advantages. In particular, a reliable shadowing of solar radiation is achieved by the slat elements on the woven-in tube means. By means of the slat elements, which are in particular lamellary formed, a far higher shading of solar radiation is achieved than by a conventional wire mesh where, for example, round wires are woven in a twill weave. By this, a larger field of application of wire mesh is possible permitting optically appealing wire mesh for shading of incidence of light and shadowing of solar radiation.

Said slat elements are in particular formed as flat shading elements having a lamellar structure with it being possible that each individual slat elements in particular at least in sections can be formed as a flat slat.

In a preferred further embodiment, the tube means or at least one tube element are and/or is formed as a transparent tube receiving the slat elements. For example, it is possible that the tube means are formed as elongate tube structures and in particular as elongate tubes, with each tube being formed in particular as a hollow tube comprising a slat element and preferably a slat. In such an embodiment, the tube means can, for example, be formed in a circular or rounded or flattened shape comprising the slat element inside under a predetermined or adjustable angle. If necessary, the angle can be movable in order to permit, for example, a seasonal orientation of individual or all slat elements.

In preferred embodiments, the tube means are formed as sleeves receiving the slat elements. Preferably, the slat elements are inserted through the sleeves with the sleeves being arranged on the slat elements in particular in predetermined spaces and serving for support and guidance of the slat elements. The sleeves may also be an integral part of the slat elements.

In particular, the tube means are at least partially enclosed by the warp wires and locally fixed by the warp wires.

For example, it is possible that a glass or plastic tube is inserted through the sleeves with at least one slat element being received inside the glass and/or plastic tube.

But it is also possible that the tube means itself is comprised of glass or plastics and is directly woven into the wire mesh and is, for example, held by the warp wires. In such an embodiment, the tube means serve as weft wires. But an opposite arrangement is possible as well where the warp wires are formed as tube means and the weft wires are conventional wires.

Preferably, the tubes in the tube means comprise an at least partially rounded and in particular approximately oval external cross section. But it is also possible that the tube means comprise an elliptical or convex external cross section. The cross section can also be round or pressed flat or formed as a flattened circle. If the tube means is used as a weft wire and held in position by the warp wires, an oval tube means, for example, has the advantage that during weaving the tube means adopts a defined position relative to the warp wires when the warp wires at least partially surround the tube means. Such a preferred orientation of the tube means towards the mesh surface can generally be provided for all non-circular external cross sections. An external outline at least principally oval or elliptical permits a favorable structure of the wire mesh with a defined orientation of the tube means.

Preferably, the slat elements are formed as separate strips. For example, it is possible to form the slat elements as separate metal or plastic strips the width of which is considerably greater than their thickness. Preferred are width to thickness ratios greater than 5 and in particular greater than 10. The precise embodiment and dimensions depend on the intended use and on the dimensions of the wire mesh in total as well as on the thickness of the warp and weft wires used. Also the distance of the individual slat elements affects the dimensions of the respective slat elements. The greater the distance of one slat element to the next slat element, the greater generally the width of a slat is chosen.

This applies in particular, if the slat elements are positioned inclined towards the mesh surface. Such an embodiment permits a particularly efficient sun protection, in particular on windows with vertical orientation. In the event of slats orientated inclined and in particular approximately vertically to solar incidence, an entire shading of the interior is possible, with an almost unimpeded view from the inside towards the outside being permitted. It is also possible to adjust the angle of the slat element to the mesh surface.

But it is also possible that the slat elements are aligned in parallel with the mesh surface. For example, in the event of inclined roof-lights such an efficient shading is achieved with it being possible that a view and, for example, a minor incidence of light between the individual slat elements is provided. If required, the slat elements are placed staggered towards the mesh surface so that, for example, one slat is rather placed on one side of the wire mesh, whereas another slat is rather placed on the other side of the wire mesh. In such an embodiment, slats aligned in parallel to the mesh surface can also permit an entire shading, even if the wire mesh is not aligned vertically.

Preferably, the slat elements are arranged on the tube means and in particular attached there. For example, the slat elements can be received on the tube means and, defined by a corresponding inner contour of the tube means, guided on the tube means. This permits the angle of the slat elements towards the mesh surface to be predetermined by the tube means.

In a particularly preferable embodiment at least one slat element is provided with at least a photovoltaic cell. Such an embodiment is particularly advantageous since it opens up further advantageous fields of application. Such an embodiment does not only permit shadowing but simultaneous production of electric current with the individual slats being able to produce current and to serve as flat shading elements at the same time.

In another embodiment according to the invention and claimed separately, a wire mesh according to the invention comprises warp and weft wires with the warp wires fixing at least some tube structures on which flat shading elements are received.

This wire mesh according to the invention has many advantages as well. Due to the fact that the warp wires clamp at least some tube structures on which flat shading elements are received, a shading mesh is provided which permits a permanent shadowing, for example, of an interior space.

In particular, the flat shading elements can, at least partially, be provided with photovoltaic cells. In that case, the flat shading elements serve at the same time for shading the incidence of light and also for power generation. Such an embodiment has many advantages. When used in regions with high solar radiation, the wire mesh can considerably reduce the incident solar radiation, for example on a building which in turn decreases the cooling load requirement considerably. At the same time, by power generation of the photovoltaic cells, operation of an air conditioning system can be permitted or at least assisted, so that the total energy demand of the building is considerably decreased. It is also possible that a building cladded with such a wire mesh produces excessive energy and feeds it into the public grid.

The warp wires fix the tube structures and/or in particular keep them clamped in space such that the flat shading elements are received on them.

Another wire mesh according to the invention comprises warp and weft wires with at least some warp and/or weft wires each being formed as slat elements and provided at least partially with photovoltaic cells in order to serve for shading of incidence of light and for power generation.

Such an embodiment is very advantageous since due to the lamellar structures of the slat elements a flat shading is permitted whereas at the same time it is possible due to the photovoltaic cells to generate power. Thus it is permitted in a better way to provide a self-sufficient building which requires as little as possible or no supply of external energy at all.

In particular, photovoltaic cells are disposed on the slat elements. Two purposes are fulfilled with the slat elements as a result, namely on the one hand the interior space behind the wire mesh is shaded and at the same time power is generated.

In all embodiments it is preferred that the photovoltaic cells are applied on the slat elements. The photovoltaic cells can in particular be glued on or directly vapor-deposited or coated onto the slat elements.

In particular it is preferred that the slat elements are provided with the photovoltaic cells prior to manufacture of the wire mesh. Particularly simple is then a coating or vapor-deposition or, as the case may be, a gluing or any other type of application or fastening. Subsequently the wire mesh is produced from the slat elements, with it being possible that the slat elements can serve directly as warp and/or weft wires or with the slat elements being inserted into corresponding tube means. In particular it is preferred that the weft wires are formed as slat elements with it being possible that the weft wires in particular are formed as flat strips made out of metal or a synthetic or natural material, with the photovoltaic cells being disposed on or behind the flat strips.

It is particularly preferred that at least some warp wires are coated with a slide layer. Such a slide layer may be a synthetic material which during manufacture of the mesh protects the photovoltaic cells against an abrading destruction. If the weft wires formed as slat elements prior to manufacture of the wire mesh are fed with the solar cells, contact of a metal warp wire with the slat element as a weft wire during weaving can result in such a loading of the photovoltaic cell that it is scratched on the surface or even entirely destroyed. By using a slide layer on the warp wires, the surface loading of the photovoltaic cells is considerably reduced so that the photovoltaic cells survive the weaving process undamaged.

In the embodiments it is preferred that the warp wires are arranged in groups with each group comprising at least two warp wires. The free space of two groups is in particular greater than the double and in particular the triple space of two warp wires.

Preferably, each group has two to seven warp wires respectively. Particularly preferably each group has three to five warp wires, with the individual warp wires of a group being relatively closely adjacent to each other, whereas the distance to the next group is considerably greater and can also be equal to the decuple or more of the distance of two warp wires.

In all embodiments it is preferred that the slat elements are aligned approximately in parallel to the mesh surface. But it is also preferred that the slat elements are oriented towards the mesh surface under an angle which is in particular more than 10°. Possible and preferred are also angles of 20°, 30°, 40°, 50°, 60° and more as well as intermediate angles of the angles mentioned.

A slide layer or a layer or support reducing friction can be provided flatly or on the contact points of the individual elements and in particular on the warp and/or weft wires.

A preferred application of the wire mesh is the use on or in a facade element or as a shadowing means.

Other advantages and features of the present invention result from the embodiments which are explained below with reference to the attached figures where:

Figure 1:
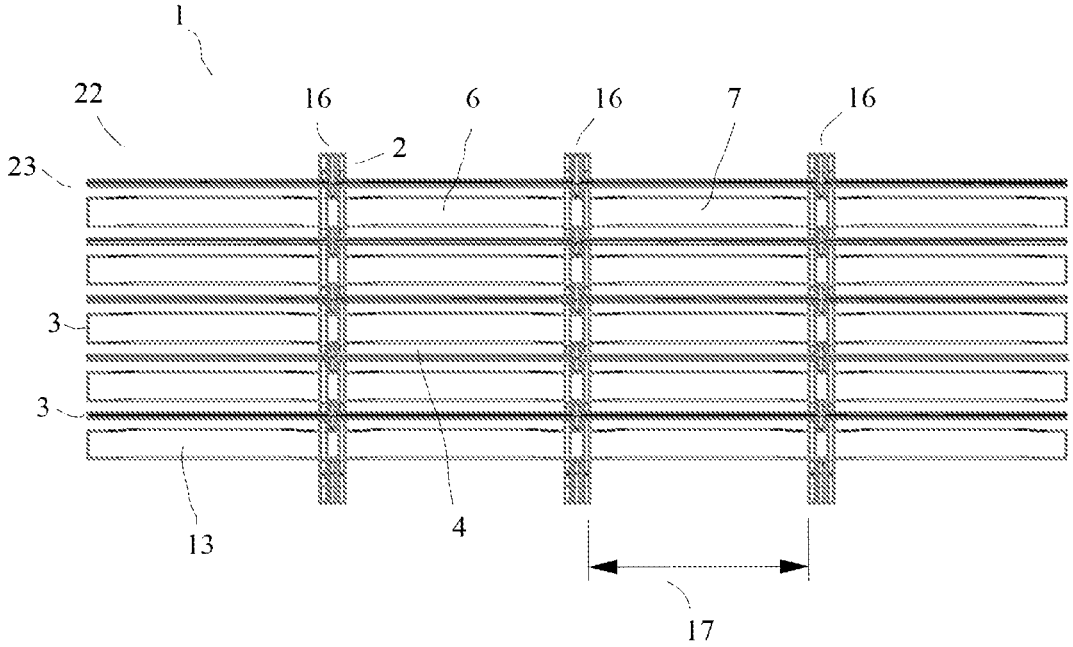
FIG. 1 is a schematic front view of a wire mesh according to the invention.
Figure 3:
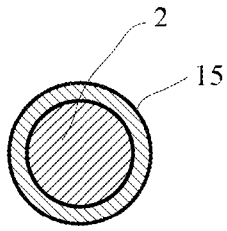
Figure 4:
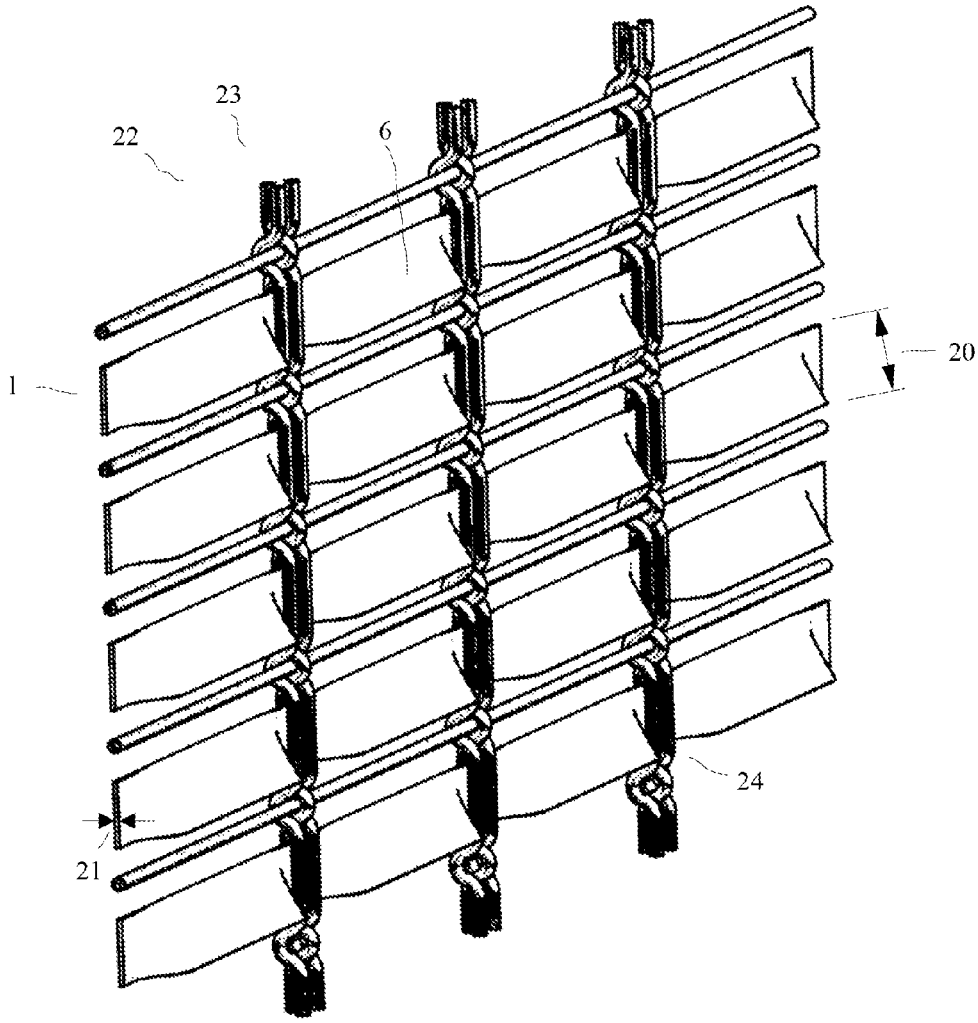
Figure 5:
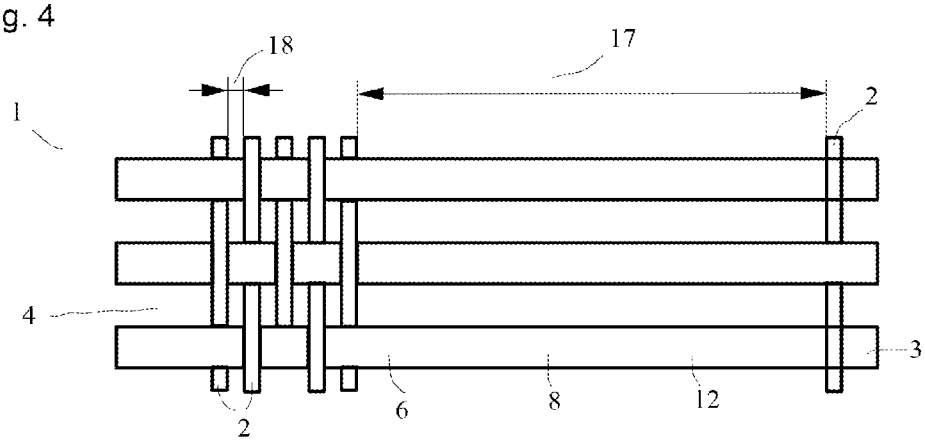
Figure 6:
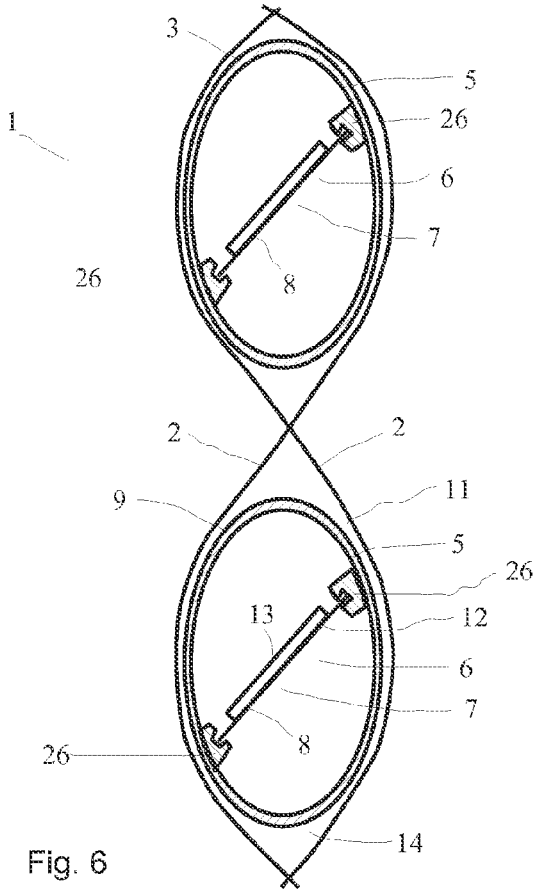
Figure 6A:
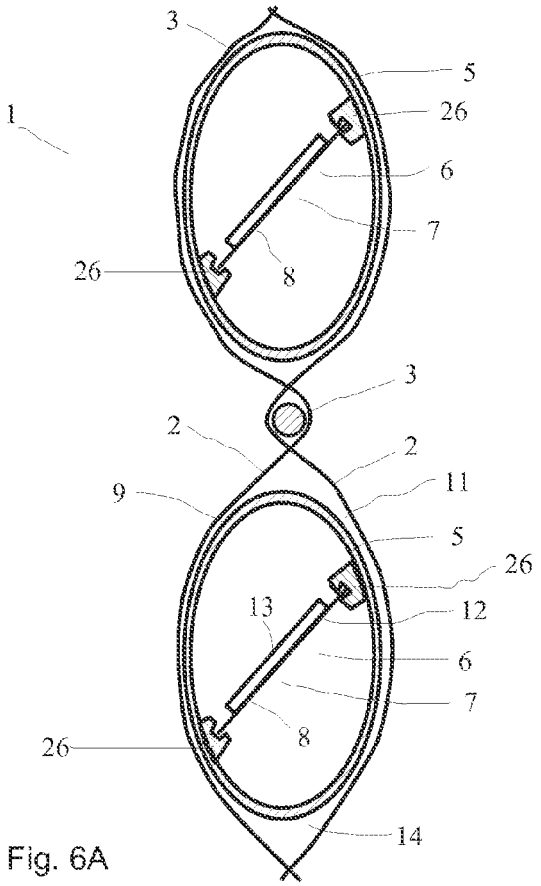
Figure 7:
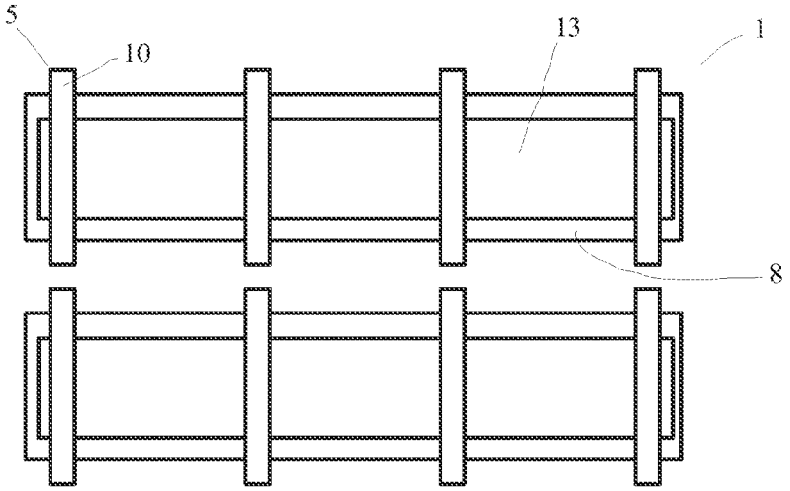

FIG. 3 in a schematic view shows a warp wire of the wire mesh according to FIG. 1;

FIG. 4 is a perspective view of the wire mesh according to FIG. 1;

FIG. 5 is an alternative embodiment of a wire mesh according to the invention in a front view;

FIG. 6 is a cross section of another wire mesh according to the invention; and FIG. 6A is a cross-section of an embodiment according to the invention; and FIG. 7 is another embodiment of the wire mesh according to the invention in a schematic view.

In FIGS. 1 to 7 embodiments of a wire mesh 1 according to the invention are shown which can be used as a shadowing means 22, for example as a facade element 23.

The wire mesh 1 shown in a schematic front view in FIG. 1 comprises warp wires 2 and weft wires 3 and is provided with a mesh surface 4. Here in the embodiment, two different weft wires 3 are used alternatingly, with one weft wire 3 being formed as a conventional and typically round weft wire 3 with a diameter of typically 1 to 5 mm, whereas the other weft wire 3 is formed as a slat element 6 which serves as a shading element 7.

The warp wires 2 are arranged in groups 16 of approximately two to approximately seven warp wires 2 each. Here in the embodiment according to FIG. 1 each group 16 comprises three warp wires 2 which surround the weft wires 3 in a relatively closely adjacent way.

In this connection the clearance 18 (see FIG. 5) between two warp wires 2 corresponds approximately to the wire diameter of one warp wire 2. But the clearance 18 of two warp wires may also be chosen smaller or greater. Each group, however, has a free space 17 to the adjacent group 16 which is at least a multiple of the clearance of two warp wires 2. This means that the clearance of two groups 16 is typically at least the decuple of the clearance 18 of two warp wires 2.

Photovoltaic cells 13 are arranged here on the shading elements 7 so that the wire mesh 1 serves not only for shading of areas arranged behind but also for power generation.

Figure 2:
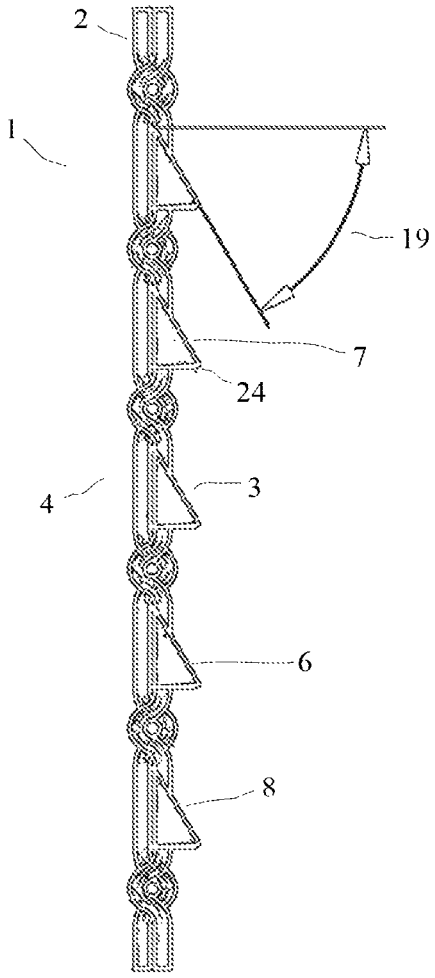
FIG. 2 is a side view of the wire mesh according to FIG. 1.

FIG. 2 shows a side view of the wire mesh 1 according to FIG. 1, with the weft wires 3 being formed as slat elements 6 and comprising shading elements 7. The shading elements 7 formed as slats 8 here have an angle 19 to the horizontal which is for example 60°. Other angles are possible as well such as for example also angles of 20°, 30°, 40°, 50° and also 70°. Intermediate angles are possible as well.

The precise angle 19 depends on different influencing factors such as for example the desired shadowing in the space adjacent to the wire mesh 1. Moreover, the angle 19 is determined by the distance of two shading elements 7 and their respective width 20 (see FIG. 4). The larger the width 20 of the shading elements 7, the greater is the shading effect of an individual shading element 7. The smaller the width is, the lesser is the impeding effect when looking through viewed from a certain distance. The precise dimensions are therefore planned according to the current requirements.

In FIG. 3 a cross section of a warp wire 2 is shown which here in the embodiment is sheathed by means of a slide layer 15. The warp wires 2 are provided with the slide layer 15 prior to the weaving process in order to decrease friction between the warp wires 2 and the weft wires 3 during the weaving process. A reason for it is that in many cases the weft wires 3, which are formed in a lamellary way, are coated with the solar cells 13 prior to the weaving process. This results in the fact that during the weaving process care should be taken that the solar cells 13 are not damaged, since a failure of the solar cells may result in an improper functioning of an entire wire mesh 1. The slide layer 15, for example, can be comprised of an adequate plastic coating but may in addition also comprise anti-friction agents in order to facilitate the weaving operation.

It has turned out that subject to the current weaving conditions a higher quality can be achieved with a slide layer 15.

FIG. 4 shows a perspective view of the wire mesh 1 with the width 20 of the slats 8 and the thickness 21 of the slats 8 being drawn in. The width 20 is here a multiple of the thickness 21 and can be more than tenfold or twentyfold of the thickness 21.

Generally it is possible that the slats 8 have strip shape with it being possible that the surface of the strip 12 is virtually entirely within the mesh surface 4. Such an embodiment facilitates the weaving operation and produces sufficient results in many cases.

In FIGS. 1 to 4, however, an embodiment of a wire mesh 1 is shown, in which the slats 8 on the points of intersection with the warp wires 2 are recessed and expanded so that the slats 8 over their major width are aligned to the vertical under angle 1. This permits on the one hand an easier weaving operation and on the other an especially efficient shading, for example, of solar radiation. Due to the angle or bending, the sun standing high in summer is kept off whereas at the same time a view from the inside is possible.

The group 16 of three warp wires 2 here produces a reliable hold of the wire mesh 1.

In FIG. 5 another embodiment is shown, in which the slats 8 of the slat elements 6 are formed as weft wires 3 and extend virtually entirely in parallel to the surface of the mesh surface 4. Such an embodiment offers itself for example for inclined wire mesh which are used for example for sheathing of roof-lights or the like. Due to the slats 8 arranged within the mesh surface, a reasonable shading is achieved while at the same time a certain portion of light still passes through.

Photovoltaic cells 13 are again located on the slats 8 in order to generate power.

FIG. 6 shows a cross section of another wire mesh 1 according to the invention which is here shown schematically in a cross section. The wire mesh 1 comprises warp wires 2 and weft wires 3, with the weft wires 3 being formed as tube means 5 here. It is possible here that the tube means 5 extend over the entire width of the wire mesh 1 and have a hollow or transparent shape. Inside a tube means 5 holders 26 are provided which serve for receiving slat elements 6. Each slat element 6 serves as a shading element 7 and is formed here as a slat 8 onto which photovoltaic cells 13 are located.

The slats 8 can be formed as rectangular strips 12 and be comprised, for example, of plastic material or of metal. After completion of the wire mesh 1, the slats 8 can be inserted into the tube means 5 or they are introduced into the tube means 5 prior to the weaving operation.

The holders 26 are provided and arranged in the tube means 5 such that a specific angle of orientation of the shading elements 7 to the surface of the mesh surface 4 results.

In the present embodiment the tube means 5 are not of round shape but present an external cross section 11 which is, for example, of oval or elliptical shape. Due to such an embodiment, in which the long semi-axis is clearly longer than the short semi-axis, an automatic orientation of the individual tube means 5 to the mesh surface 4 results in the weaving operation. Such an embodiment is particularly advantageous, since a direct orientation of the shading elements 7 to the mesh surface 4 is permitted as a result.

On the contrary, in the case of tube means with round shape, each individual slat 8 would have to be oriented in angle towards the tube means 5, in order that the desired shading is produced and a homogeneous, visual impression from the inside occurs. By means of such egg-shaped or flattened external cross sections 11, an automatic orientation is ensured which renders assembly considerably simpler and thus more cost-effective.

Each slat 8 can be provided with photovoltaic cells 13. In this connection it is possible that the photovoltaic cells 13, as shown in FIG. 6, are glued on as separate elements. It is also possible that the photovoltaic cells are vapor-deposited, glued or coated directly onto the slats 8. But it is also possible to provide the slats 8 with photovoltaic cells 13 from both sides.

The individual warp wires 2 can each have a coating 15 in order to facilitate the weaving operation. It is also possible to provide a coating or slide coating on the outside of the tube means 5 or the sleeve 10.

In an alternative embodiment of the embodiment in FIG. 6 the tube means 5 are not executed continuously but are executed only as sleeves 10 which are only provided on the contact points with the warp wires 2. As a result, generally the same cross section as in FIG. 6 can be produced, but with the individual tube means 5 executed as sleeves 10, as is shown in FIG. 7, over the width of the wire mesh 1 being only located in predetermined locations spaced apart from each other.

It is possible that the slats 8 are surrounded by another tube or the like which is inserted through the sleeves 10. But it is also possible and preferred that the sleeves 10 are woven in during the weaving operation and that subsequently or previously the slats 8 with the photovoltaic cells 13 are introduced through the sleeves 10. The photovoltaic cells 13 can be provided on the entire width of the slats 8 or only on a part of the width of the slats 8.

The individual slats 8 can be fixed resiliently on the holders 26. For example, rubber lips or the like can clamp or locate the slats 8. The slats 8 can also be fixed in any other way.

In all embodiments it is possible to provide a frame around the wire mesh, which, if required, can be deflected in angle, so that the wire mesh in total is not oriented vertically but can be deflected vis-à-vis the vertical, in order to permit an adjustment, for example, to the position of the sun.

The slats 8 can be executed as straight strips 12 or can be corrugated in themselves. The bulges 24 on the slat elements 6 of the wire mesh according to FIGS. 1 to 4 can be executed in an angle of up to +/−30° or more. This permits to arrange the slat elements locally within the bulge inside the mesh surface on the contact points of the warp wires with the slat elements, whereas the adjacent locations are oriented under a corresponding angle 19 to the vertical.

A wire mesh 1 according to the invention can, for example, have a width of up to 3 meters whereas the length can be up to 100 meters or more. When the warp wires are formed as slat elements, the height is limited to the dimensions and the width of the weaving machine, whereas the length is generally unlimited. Such an embodiment offers itself for example, when fences or the like are manufactured. In the case of facade cladding for high rise buildings, however, it is more advantageous, if the width is, for example, 2 meters, 3 meters or 4 meters, whereas the individual facade elements 23 are clearly higher.

The sleeves 10, as they are shown in the embodiment according to FIGS. 6 and 7, can be made from a metal tube but can also be comprised of plastic material or ceramics or the like. If the sleeves have a round shape inside, a simple angular adjustment can be realizable.

| List of Reference Numerals: | |
|---|---|
| 1 | wire mesh |
| 2 | warp wire |
| 3 | weft wire |
| 4 | mesh surface |
| 5 | tube means |
| 6 | slat elements |

-continued

| List of Reference Numerals: | |
|---|---|
| 7 | shading element |
| 8 | slat |
| 9 | tube |
| 10 | sleeve |
| 11 | external cross section |
| 12 | strip |
| 13 | photovoltaic cell |
| 14 | tube structure |
| 15 | slide layer |
| 16 | group |
| 17 | space between two groups |
| 18 | clearance between two warp wires |
| 19 | angle |
| 20 | width |
| 21 | height |
| 22 | shadowing means |
| 23 | facade element |
| 24 | bulge |

The invention claimed is:

1. Wire mesh with warp and weft wires forming a mesh surface, characterized in that on the mesh surface tube means spaced apart from each other are directly woven in on which slat elements are located in order to serve for shading of the incidence of light, with the tube means being formed as transparent tubes in which the slat elements are directly received.

2. Wire mesh according to claim 1, with the tube means being formed as sleeves in which the slat elements are received.

3. Wire mesh according to claim 1, with the tube means having an at least partly rounded external cross section.

4. Wire mesh according to claim 1, with the slat elements being formed as separate strips.

5. Wire mesh according to claim 1, with the slat elements being arranged inclined towards the mesh surface.

6. Wire mesh according to claim 1, with the slat elements being oriented in parallel to each other.

7. Wire mesh according to claim 1, with the tube means being fixed on the slat elements.

8. Wire mesh according to claim 1, with an angle of the slat elements to the mesh surface being predetermined by the tube means.

9. Wire mesh according to claim 1, with at least one slat element being provided with at least one photovoltaic cell.

10. Wire mesh according to claim 1, with the slat elements serving as flat shading elements.

11. Wire mesh according to claim 1, with the tube means with the slat elements serving as weft wires.

12. Facade element or shadowing means with at least one wire mesh according to claim 1.

* * * * *